US005616188A

United States Patent [19]

Kato et al.

[11] Patent Number: 5,616,188

[45] Date of Patent: Apr. 1, 1997

[54] METHOD OF PRODUCING MOLTEN ALUMINUM-KILLED STEEL FOR THIN STEEL SHEET

[75] Inventors: Yoshiei Kato, Chiba; Seiji Nabeshima, Okayama; Yoichi Ito, Okayama; Kenichi Sorimachi, Okayama, all of Japan

[73] Assignee: Kawasaki Steel Corporation, Japan

[21] Appl. No.: 540,868

[22] Filed: Oct. 11, 1995

[30] Foreign Application Priority Data

Oct. 18, 1994 [JP] Japan ..... 6-252087

[51] Int. Cl.[6] ..... C21C 7/076

[52] U.S. Cl. ..... 148/508

[58] Field of Search ..... 75/508

[56] References Cited

U.S. PATENT DOCUMENTS 4,043,798 8/1977 Nashiwa et al. ..... 75/508

*Primary Examiner*—Deborah Yee

*Attorney, Agent, or Firm*—Austin R. Miller

[57] ABSTRACT

In a method of producing a molten aluminum-killed steel for forming a thin steel sheet, molten steel tapped from a converter is decarburized to a predetermined carbon concentration by using a vacuum degasser, and Al is added to the molten steel in the vacuum degasser to deoxidize the molten steel. A material containing metallic Ca is then added to the molten steel to produce a Ca content of about 0.0005 to 0.005 wt %, and to satisfy [%Ca]×[%S]≦ about $2\times10^{-5}$. Thereafter, degassing is performed on the molten steel.

2 Claims, 2 Drawing Sheets

METHOD OF PRODUCING MOLTEN ALUMINUM-KILLED STEEL FOR THIN STEEL SHEET

BACKGROUND OF THE INVENTION

1. Field of the Invention

This invention relates to a method of producing molten aluminum-killed steel as a raw material for cold-rolled steel sheets or the like. More particularly, this invention relates to a method which prevents clogging of an immersion nozzle by $Al_2O_3$-system inclusions. Such clogging can occur when molten steel is poured from a tundish into a mold through an immersion nozzle. In addition, this invention inhibits the rusting and surface defects on a cold-rolled steel sheet caused by $Al_2O_3$-system inclusions.

2. Description of the Related Art

Recently, with the development of the secondary refining techniques, the formation of a thin steel sheet through continuous casting of aluminum-killed steel has become possible. In particular, the development of vacuum degassing techniques has made such production possible.

The formation of a thin steel sheet through continuously casting of aluminum-killed steel using vacuum degassing techniques typically includes the following four steps:

a. converter steelmaking, b. a vacuum degassing treatment in a ladle, c. pouring molten steel from the ladle into a tundish, and d. continuous casting.

Ordinarily, A is added after tapping from the converter ($C \geqq 0.02\%$) or after the vacuum degassing treatment ($C<0.02\%$) to deoxidize molten steel. The additions of Al, however, generate fine clusters of high-melting-point $Al_2O_3$-system inclusions. These high-melting-point $Al_2O_3$-system inclusions cannot be floated and separated by performing vacuum degassing in the ladle. Consequently, the $Al_2O_3$-system inclusions attach to the inner surface of an immersion nozzle to clog the nozzle when the molten steel is poured from the ladle into the tundish.

To reduce such nozzle clogging, a method of blowing an inert gas into the nozzle and a method of adding Ca to convert $Al_2O_3$-system inclusions into a low-melting-point oxide composite material consisting of Ca and $Al_2O_3$ are known. However, the method of blowing inert gas into the nozzle entails the risk of inert gas being introduced into the mold which causes surface defects in a casting under certain blowing conditions. Moreover, the technique of adding Ca to prevent attachment of alumina inclusions to the inner surface of an immersion nozzle fails to address the problem of rust formation on a product of casting under various operating conditions.

Methods provided to overcome these problems, e.g., those disclosed in Japanese Patent Laid-Open Nos. 276756/1986 and 599/1994, are known.

In the method disclosed in Japanese Patent Laid-Open Nos. 276756/1986, aluminum-killed steel having a C concentration of 0.015 wt. % or less is prepared and Ca or a Ca alloy is added to the molten steel in the melting step or during continuous casting to provide 2 to 40 ppm residual Ca in the molten steel in an attempt to prevent immersion nozzle clogging and product rusting.

In the method disclosed in Japanese Patent Laid-Open No. 599/1994, immersion nozzle clogging and product rusting is limited by adding Ca to a molten aluminum-killed steel having an ultra low-carbon content. Ca concentration is maintained in the range of 5 to 10 ppm, and the inner surface of the immersion nozzle is formed by a refractory material having a CaO content of 15 wt. % or more.

Each of the above-described methods makes it possible to prevent immersion nozzle clogging, but fails to adequately prevent product rusting because neither method can be adapted to a wide range of operating conditions.

That is, with respect to the above-described methods, controlling the generation of CaS, which is a crucial factor in rusting, has not been considered. For this reason, concurrent prevention of nozzle clogging and rusting has not been adequately achieved.

SUMMARY OF THE INVENTION

In view of the above-described problem, an object of the present invention is to provide a method of producing a molten aluminum-killed steel for forming a thin steel sheet which prevents rusting on a product of casting under any condition while also reliably preventing the clogging of an immersion nozzle, and which further prevents product surface defects (packed scab, blister or sliver) due to $Al_2O_3$-system inclusions.

To achieve this object, according to the present invention, there is provided a method of producing a molten aluminum-killed steel for the formation of a thin steel sheet which involves decarburizing molten steel tapped from a converter to a predetermined carbon concentration by using a vacuum degasser, adding Al to the molten steel in the vacuum degasser to deoxidize the molten steel, then adding a material containing metallic Ca in such a range that, in the molten steel, the content of Ca is about 0.0005 to 0.005 wt. % and $[\%\ Ca]\times[\%\ S] \leqq$ about $2\times10^{-5}$ . Thereafter, degassing is performed.

Equivalent steps will become apparent to those skilled in the art from the following description of the invention and the scope of the appended claims.

DESCRIPTION OF THE PREFERRED EMBODIMENT

Figure 1:
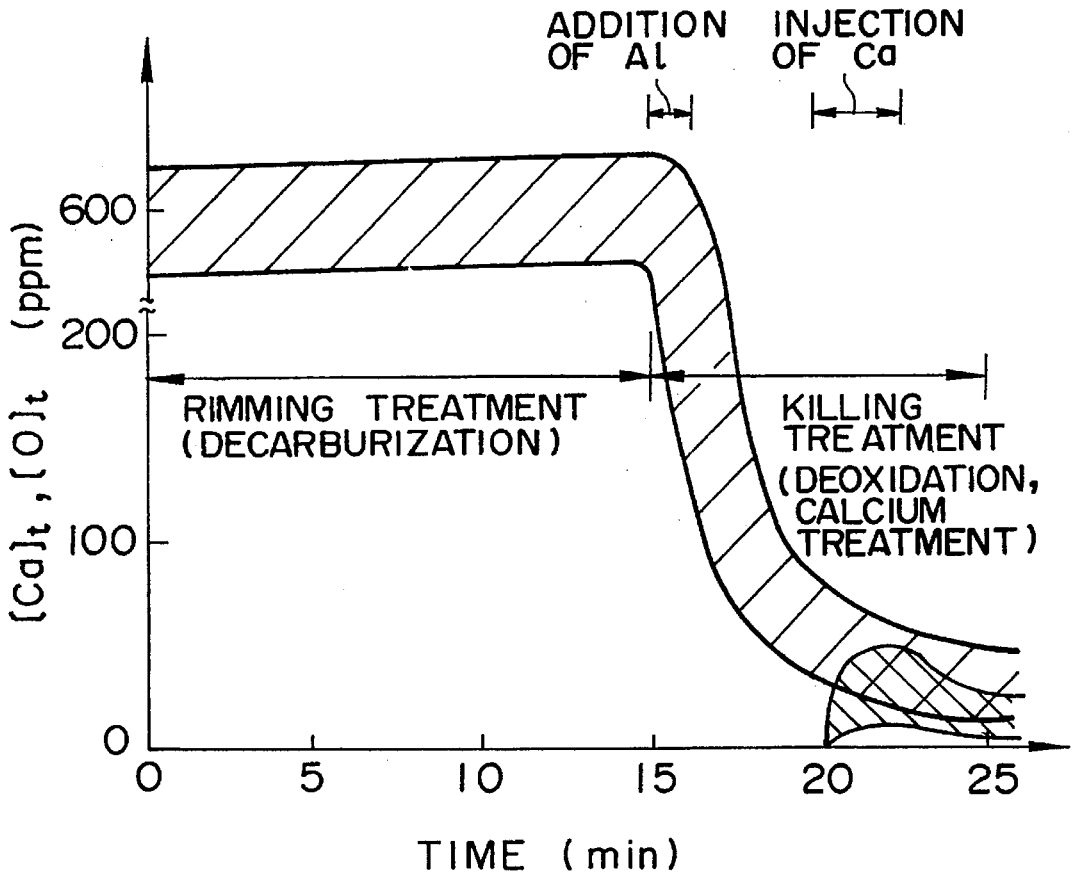
FIG. 1 is a graph showing changes in $[Ca]_t$ and $[O]_t$ during an RH vacuum degassing treatment.

The present invention is characterized in that, when a Ca treatment is performed after deoxidization by Al the formation of $Al_2O_3$ inclusions in a $CaO$-$Al_2O_3$ system having an excessive Ca concentration is efficiently controlled to prevent nozzle clogging during casting. Additionally, surplus Ca is evaporated and removed by a vacuum treatment to prevent precipitation of CaS at the time of solidification, whereby rusting is prevented on the resulting product.

The vacuum degasser used in accordance with the present invention may be adapted to an RH vacuum degassing process, a Vacuum Oxygen Decarburizing process (VOD) or a Vacuum Arc Degassing process (VAD).

The present invention will be described with respect to an RH vacuum oxygen degassing process.

As in conventional methods, the present invention controls the form of $Al_2O_3$ inclusions by adding Ca, thus reducing the melting point of the $Al_2O_3$ inclusions. The $Al_2O_3$ inclusions are thereby prevented from attaching to the inner surface of the nozzle.

A Ca concentration suitable for preventing attachment of the inclusions in the nozzle is about 5 to 50 ppm. If the Ca concentration is lower than about 5 ppm, the amount of CaO generated by the reaction of the following formula:

$$Al_2O_3+3Ca \rightarrow 3CaO+2Al \quad (1)$$

is so small that there is inadequate control of the form of the $CaO-Al_2O_3$ system. On the other hand, Ca added in the above-mentioned range provides the desired form control. In view of economic considerations, the upper Ca concentration limit is about 50 ppm. As long as the above-mentioned Ca concentration condition is satisfied, casting can be performed normally even without blowing gas in the nozzle.

To furnish Ca to the molten steel, Ca may be directly incorporated into the molten steel in an RH vacuum bath. Alternatively, Ca may be blown into the molten steel in a ladle from a lance coated with a refractory material so that a powder or vapor of Ca passes through an RH immersion pipe (riser).

According to the above-described method, no gas or fumes are released into the surroundings, thereby avoiding environmental problems. Also, since the molten steel is circulated through a vacuum bath and a ladle, both the agitation efficiency and the efficiency of the form control reaction of Ca and $Al_2O_3$ are improved.

Extensive experimentation on the rusting phenomenon of aluminum-killed steel to which Ca is added was conducted to determine the cause of the phenomenon. It has been discovered that a strong correlation exists between rusting of aluminum-killed steel and the generation of CaS inclusions.

That is, if Ca is excessively added, the amount of dissolved Ca is larger than is necessary for controlling the form of $Al_2O_3$. Consequently, excess Ca reacts with S in the steel to form fine clusters of sulfide-system inclusions mainly consisting of CaS. If such sulfide-system inclusions mainly consisting of CaS exist in an exposed state at the surface of a steel sheet, and if the steel sheet undergoes a rusting test in which, for example, a sample is set for 10 hours in a constant-temperature, constant-humidity bath having a temperature of 60° C. and a humidity of 90%, then the inclusions are decomposed and eluted to form pits in the surface, and a new surface is thereby exposed to rust. Therefore, it can be said that rusting phenomenon is primarily caused by sulfide inclusions mainly consisting of CaS.

To prevent such rusting, Ca remaining in the molten steel after $Al_2O_3$ form control may be removed immediately to limit the generation of CaS.

According to the present invention, therefore, degassing is performed subsequently to the above-described $Al_2O_3$ form control step in order to remove surplus Ca. That is, Ca is added during the RH vacuum degassing process for $Al_2O_3$ form control and, once the addition of Ca is stopped, Ca having a high vapor pressure is rapidly evolved from the free surface of the vacuum bath. Therefore, if the rate of supply of Ca is suitably controlled, substantially no dissolved Ca exists after the completion of the RH vacuum degassing process. Accordingly, substantially no CaS exists at the time of continuous casting.

FIG. 1 shows the results of the measured changes in $[Ca]_t$(total Ca concentration) and $[O]_t$(total O concentration) during the RH vacuum degassing process.

As shown in FIG. 1, by addition of Al at the initial stage of a killing treatment, $[O]_t$ decreases abruptly. When $[O]_t$ becomes sufficiently low, Ca is blown in for a predetermined period. During this Ca blowing, the Ca content is maintained at about 0.0005 to 0.005 wt. % to limit the reduction in the $Al_2O_3$ form control rate. If the degassing treatment is continued after the completion of Ca blowing, the dissolved Ca is removed by evaporation so that [Ca] in the steel decreases gradually.

Figure 2:
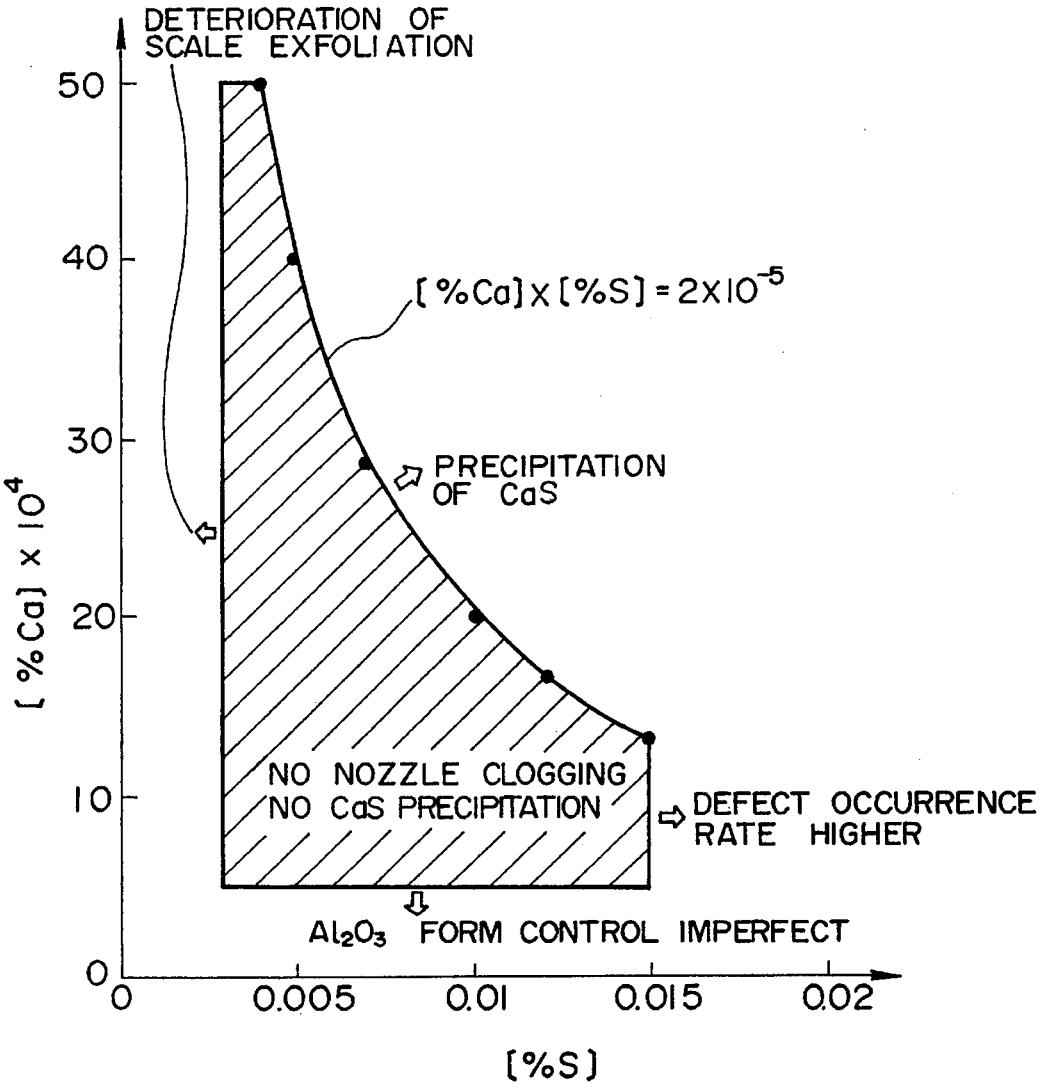
FIG. 2 is a diagram showing the influence of [% Ca] and [% S] in steel upon nozzle clogging, precipitation of CaS, exfoliation of scale and surface defects.

FIG. 2 shows the result of an experiment conducted to examine the relationship between Ca and S in steel as they influence rusting. This experiment was conducted with respect to carbon steel having about 0.005 to 0.06 wt. % of Al and about 0.008 wt. % or less of O and for forming a cold-rolled steel sheet.

As revealed in FIG. 2, when [% Ca]×[% S] was larger than about $2\times10^{-5}$, CaS precipitated during the solidifying stage.

A rusting test was performed on a product sheet where the sheet was maintained for 10 hours in a constant-temperature, constant-humidity bath having a temperature of 60° C. and a humidity of 90%. Rust was observed.

When [% Ca]< about $5\times10^{-4}$, control of the form of $Al_2O_3$ was imperfect. Therefore, to sufficiently control the form of $Al_2O_3$, about 0.0005 wt. % or more of Ca is required. However, if the content of Ca is larger than about 0.0050 wt. %, the concentration of S must be about 0.004% or less. To achieve this S concentration, a high desulfurizing cost is incurred. If the concentration of S is lower than about 0.003%, the exfoliation of scale deteriorates, as described in detail below.

According to the present invention, therefore, a quantity of Ca in the ravage of about 0.0005 to 0.005 wt. % and satisfying [% Ca]×[% S]≦ about $2\times10^{-5}$ is added during the Ca treatment of carbon steel.

If the S content in the steel is less than about 0.003 wt. %, the exfoliation of scale on the surface of a slab or hot coil deteriorates. If the content of S exceeds about 0.015 wt. %, the surface and internal defect occurrence rates become higher. Therefore, it is desirable to control S content within the range of about 0.003 to 0,015 wt. %.

If the O content in the steel exceeds about 0.008 wt. %, the form of the inclusions is not sufficiently controlled whereby surface and internal defects increase. Therefore, it is desirable to limit the O content to no more than about 0,008 wt. %.

As described above, it is preferred in the present invention that the concentrations of Al, S and O in the molten steel be Al: about 0.005 to 0.06 wt. %, S: about 0.003 to 015 wt. %, and O: about 0.0080 wt. % or less.

Al so, according to the present invention, as a material containing metallic Ca, iron coated metallic Ca, a Ca—Al alloy, a Ca—Si alloy or the like is preferred.

EXAMPLES

The invention will now be described through illustrative examples. The examples are not intended to limit the scope of the invention defined in the appended claims.

280 to 300 tons of molten steel tapped from a converter and containing 0.02 to 0.04 wt. % of C, 0.003 to 0.015 wt. % of S and 0.05 to 0.07 wt. % of O was processed for 15 minutes by a vacuum decarburizing treatment using an RH vacuum degasser. After the decarburizing treatment, the C content was 0.0012 to 0.0020 wt. %, while the O content was 0.04 to 0.06 wt. %.

After the decarburizing treatment, 400 to 600 kg of Al was added to the molten steel in an RH vacuum bath. The O content in the steel was thereby reduced to 0.001 to 0.008 wt. %.

Three to four minutes after the addition of Al, a Ca treatment was performed.

The Ca treatment involved positioning the distal end of a lance so as to reach the bottom of a ladle right below the RH riser to blow in 80 to 150 kg of a Ca—Si powder (Ca: 30 wt. %, Si: 70 wt. %) with Ar Gas at 0.5 to 2 $Nm^3$/min. In a different process, 80 to 150 kg of Ca—Si in the form of a wire was also introduced so as to be dissolved right below the RH riser. In yet another process, 80 to 150 kg of a Ca—Si powder was directly added to the steel in the vacuum bath.

After the Ca treatment, a further degassing treatment was performed for 2 to 10 minutes.

Examinations were conducted with respect to the Ca content of the steel at the time of the Ca addition, the value of [% Ca]×[% S], nozzle clogging during continuous casting and the amount of rusting on a product casting. Table 1 shows the results of these examinations.

TABLE 1

| No. | [% Ca] | [% Ca] × [% S] × $10^{-5}$ | Rate of Ar Flow from Immersion Nozzle (Nl/min) | Immersion Nozzle Clogging | Constant-Temperature, Constant-Humidity Rusting Test of Product (10 hours) | Rate of Occurrence of Surface Defects Due to $Al_2O_3$ Inclusions (Defects/$m^2$) | Note |
|---|---|---|---|---|---|---|---|
| 1 | 0.0025 | 1.5 | 0 | no clogging | no dots of rust | 0 | Example of the Invention |
| 2 | 0.0015 | 2.0 | 0 | no clogging | no dots of rust | 0 | Example of the Invention |
| 3 | 0.0005 | 0.75 | 0 | no clogging | no dots of rust | 0 | Example of the Invention |
| 4 | 0.005 | 2.0 | 0 | no clogging | no dots of rust | 0 | Example of the Invention |
| 5 | 0.0010 | 1.0 | 0 | no clogging | no dots of rust | 0 | Example of the Invention |
| 6 | 0 | 0 | 0 | nozzle clogged in one cycle | no dots of rust | 10 | Comparative Example |
| 7 | 0.0025 | 2.5 | 0 | no clogging | 5 dots of rust/$cm^2$ | 1 | Comparative Example |
| 8 | 0 | 0 | 15 | nozzle clogged in third cycle | no dots of rust | 5–7 | Comparative Example |

As is apparent from Table 1, an ultra low-carbon Al-killed steel capable of forming a cold-rolled steel sheet which prevents both nozzle clogging and rusting on product sheets, can be prepared by performing a Ca treatment so that the Ca content is about 0.0005 to 0.005 wt. % and [% Ca]×[% S]< about $2\times10^{-5}$, and thereafter continuing the degassing treatment to evaporate and remove solid-solution Ca.

Al so, when molten steel was prepared in accordance with the present invention, no surface defects due to $Al_2O_3$ inclusions occurred.

As described above, Ca is continuously added at a particular time during a killing treatment by Al deoxidization in a vacuum degasser, and surplus solid-solution Ca is thereafter removed by evaporation. This method makes it possible to effectively prevent nozzle clogging during continuous casting as well as to prevent, in a product sheet, rusting due to the Ca treatment and surface defects due to $Al_2O_3$ inclusions.

Although this invention has been described in connection with specific forms thereof, it will be appreciated that a wide variety of equivalents may be substituted for the specific elements described herein without departing from the spirit and scope of this invention as defined in the appended claims.

What is claimed is:

1. A method of producing a molten aluminum-killed steel capable of forming a thin steel sheet, comprising the steps of:

producing molten steel in a converter;

tapping said molten steel from said converter to a vacuum degasser;

decarburizing said molten steel to produce a decarburized molten steel;

adding Al to said decarburized molten steel in said vacuum degasser to produce a deoxidized molten steel;

adding a material containing metallic Ca to said deoxidized molten steel so that the Ca content is about 0.0005 to 0.005 wt % and [%Ca]×[%S]≦ about $2\times10^{-5}$ in said deoxidized molten steel; and thereafter performing a degassing treatment on said deoxidized molten steel to produce said molten aluminum-killed steel.

2. A method according to claim 1, wherein the concentrations of Al, S and O in said molten aluminum-killed steel are Al: about 0.005 to 0.06 wt %, S: about 0.003 to 0.015 wt %, and O: about 0.0080 wt % or less.

* * * * *